US009516940B2

(12) United States Patent
Lowry

(10) Patent No.: US 9,516,940 B2
(45) Date of Patent: Dec. 13, 2016

(54) ARMBAND FOR AN ELECTRONIC DEVICE

(71) Applicant: Auria LLC, Malvern, PA (US)

(72) Inventor: David Lowry, Wayne, PA (US)

(73) Assignee: Auria LLC, Malvern, PA (US)

( * ) Notice: Subject to any disclaimer, the term of this patent is extended or adjusted under 35 U.S.C. 154(b) by 85 days.

(21) Appl. No.: 14/556,771

(22) Filed: Dec. 1, 2014

(65) Prior Publication Data

US 2015/0150359 A1 Jun. 4, 2015

Related U.S. Application Data

(60) Provisional application No. 61/911,183, filed on Dec. 3, 2013.

(51) Int. Cl.
*A45F 5/00* (2006.01)

(52) U.S. Cl.
CPC ..... *A45F 5/00* (2013.01); *A45F 2005/008* (2013.01); *A45F 2200/0508* (2013.01); *A45F 2200/0516* (2013.01)

(58) Field of Classification Search
CPC ..... A45F 2005/008; A45F 2200/0516; A45F 2200/0508; A45F 3/12; Y10S 224/93; A45C 2011/001; A45C 2011/002; A45C 13/30
USPC ..... 224/930, 219, 221, 222, 267, 236, 240,224/264, 643
See application file for complete search history.

(56) References Cited

U.S. PATENT DOCUMENTS 2,558,336 A * 6/1951 Boivin ..... D03D 15/08 139/390
4,500,019 A * 2/1985 Curley, Jr. ..... A45F 5/00 224/222
D337,197 S * 7/1993 Krutsch ..... D3/255
5,588,571 A * 12/1996 Mazzo ..... A45C 1/04 150/136
5,607,092 A * 3/1997 Alexander ..... A45C 13/30 224/258
D382,995 S * 9/1997 Hale ..... D3/215
6,321,957 B1 * 11/2001 Rossi ..... A01K 27/006 206/811
6,629,628 B1 * 10/2003 Canepari ..... A45C 1/04 150/112
6,698,636 B2 * 3/2004 Angus ..... A45F 3/00 224/660
7,004,363 B2 * 2/2006 Fenton ..... A45F 3/12 224/264
D537,623 S * 3/2007 Dennis ..... D3/218
D541,044 S * 4/2007 Wagner, II ..... D3/226
D548,959 S * 8/2007 McClain ..... D3/218
(Continued)

*Primary Examiner* — Justin Larson
(74) *Attorney, Agent, or Firm* — Panitch Schwarze Belisario & Nadel LLP

(57) ABSTRACT

An armband for an electronic device is provided. The armband includes a main body having a first surface and an opposing second surface, a first end and an opposing second end, and a longitudinal axis extending from the first end toward the opposing second end. The armband further includes a pocket formed between the first and second surfaces of the main body which is configured to removably receive an electronic device therein, an opening formed in the rear surface of the main body which provides access to the pocket and extends perpendicular to the longitudinal axis of the main body, a flap configured to cover the opening, and a securing strap configured to removably secure the main body to an arm of a user.

11 Claims, 3 Drawing Sheets

(56) References Cited

U.S. PATENT DOCUMENTS

| | | | | |
|---|---|---|---|---|
| 7,356,888 | B2 * | 4/2008 | Chao | A45F 5/00 24/306 |
| 7,367,483 | B2 * | 5/2008 | Nassanian | A45F 3/12 224/264 |
| D576,792 | S * | 9/2008 | Wagner, II | D3/226 |
| D620,706 | S * | 8/2010 | Wagner, II | D3/226 |
| D623,404 | S * | 9/2010 | Andre | D3/218 |
| D623,852 | S * | 9/2010 | Kroll | D3/226 |
| 7,810,683 | B2 * | 10/2010 | Chan | A45F 5/00 224/221 |
| 8,474,669 | B2 * | 7/2013 | Rohrbach | A45F 5/00 224/222 |
| 8,752,740 | B2 * | 6/2014 | Morgan | A45F 5/00 224/222 |
| 9,144,256 | B2 * | 9/2015 | Gheneva | A41D 27/205 |
| 2002/0023284 | A1 * | 2/2002 | Romano | A44C 5/003 2/16 |
| 2004/0089685 | A1 * | 5/2004 | Chan | A45F 3/12 224/264 |
| 2011/0031290 | A1 * | 2/2011 | Remo | A45F 5/00 224/222 |
| 2014/0263495 | A1 * | 9/2014 | Koch | A45F 5/00 224/222 |
| 2015/0150360 | A1 * | 6/2015 | Soriano | A45F 5/00 224/222 |
| 2015/0182009 | A1 * | 7/2015 | Whang | A45F 5/00 224/222 |
| 2016/0100675 | A1 * | 4/2016 | Dong | A45F 5/00 224/267 |

* cited by examiner

ARMBAND FOR AN ELECTRONIC DEVICE

CROSS-REFERENCE TO RELATED APPLICATIONS

This application claims priority to U.S. Provisional Patent Application No. 61/911,183, filed on Dec. 3, 2013, entitled "Armband for an Electronic Device," the entire contents of which are incorporated by reference herein.

BACKGROUND OF THE INVENTION

An embodiment of the present invention relates generally to an armband for an electronic device and, more particularly, to an armband for holding an electronic device while a user is performing an activity, such as walking, jogging, running, exercising and the like.

Electronic devices such as portable music players, mobile telephones (including mobile smart phones), and personal digital assistants (PDAs) are used on a daily basis by millions of people. However, carrying these electronic devices, particularly while performing an activity such as exercising, can be problematic. For example, simply carrying such electronic devices in one's pockets while running or jogging may be uncomfortable for the user and may damage the integrity of the electronic device.

Existing mechanisms for carrying electronic devices involve using: belt clips and armbands. However, the known conventional belt clips and armbands can be large or bulky and cumbersome to use while exercising. Also, the known conventional armbands typically compress the user's arm to an uncomfortable degree and do not provide sufficient protection of the electronic device against the user's perspiration or other moisture, such as a modest amount of rain or snow. More particularly, the known conventional armbands have such a construction and are made of materials such that the body of the armband becomes soaked with a user's sweat or external precipitation, thereby permitting moisture to reach the electronic device housed within the armband.

Thus, it is desirable to provide a carrier, particularly an armband, for an electronic device which is comfortable for the user and also protects the electronic device against damage that may be caused by the user's perspiration or other moisture, such as a modest amount of rain or snow.

BRIEF SUMMARY OF THE INVENTION

One aspect of the present invention is directed to an armband for an electronic device including a main body having a first surface and an opposing second surface, a first end and an opposing second end, and a longitudinal axis extending from the first end toward the opposing second end; a pocket formed between the first and second surfaces of the main body which is configured to removably receive an electronic device therein; an opening formed in the rear surface of the main body which provides access to the pocket and extends perpendicular to the longitudinal axis of the main body; a flap configured to cover the opening; and a securing strap configured to removably secure the main body to an arm of a user.

Another aspect of the present invention is directed to an armband for an electronic device including a main body having a first surface and an opposing second surface, a first end and an opposing second end, and a longitudinal axis extending from the first end toward the opposing second end; a pocket formed between the first and second surfaces of the main body which is configured to removably receive an electronic device therein; an opening formed in the rear surface of the main body which provides access to the pocket and extends perpendicular to the longitudinal axis of the main body; an insert configured to be removably received within the pocket and which includes opposing first and second surfaces; and a securing strap configured to removably secure the main body to an arm of a user. The first surface of the insert has a plurality of spaced-apart ribs and a plurality of spaced-apart channels extending generally parallel to the longitudinal axis of the main body. The plurality of spaced-apart channels are configured to divert moisture toward the second end of the main body.

Another aspect of the present invention is directed to a securing strap for an armband for an electronic device including a first surface and an opposing second surface; a first end having a first fastening element and an opposing second end having a corresponding second fastening element, the first and second fastening elements being configured to mate with each other; a center region located between the first end and opposing second end; a plurality of spaced-apart inelastic and compressible cushion members formed on the first surface in the center region, and a plurality of elastic channels formed by spaces between the plurality of spaced-apart cushion members.

BRIEF DESCRIPTION OF THE SEVERAL VIEWS OF THE DRAWINGS

The following detailed description of a preferred embodiment of the present invention will be better understood when read in conjunction with the appended drawings. For the purposes of illustrating the invention, there is shown in the drawings an embodiment which is presently preferred. It is understood, however, that the invention is not limited to the precise arrangements and instrumentalities shown. In the drawings.

DETAILED DESCRIPTION OF THE INVENTION

Figure 1:
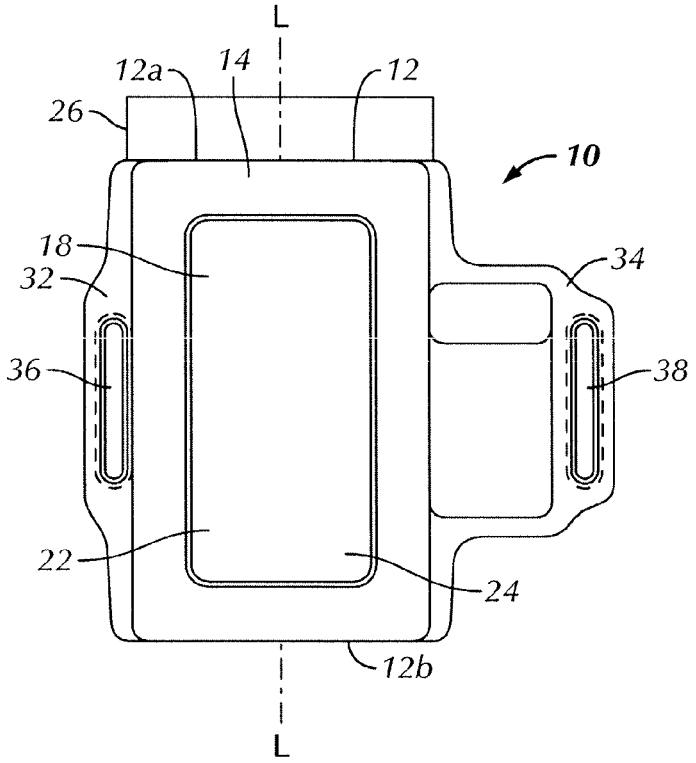
FIG. 1 is a front elevational view of a main body of an armband in accordance with a preferred embodiment of the preset invention.

Certain terminology is used in the following description for convenience only and is not limiting. The words "right", "left", "lower", and "upper" designate directions in the drawings to which reference is made. The words "inwardly" and "outwardly" refer to directions toward and away from, respectively, the geometric center of the armband and designated parts thereof. The terminology includes the above-listed words, derivatives thereof, and words of similar import. Additionally, the words "a" and "an", as used in the claims and in the corresponding portions of the specification, mean "at least one."

Referring to the drawings in detail, wherein like numerals and characters indicate like elements throughout, there is shown in FIGS. 1-7 a presently preferred embodiment of a holder, and more particularly an armband, in accordance with the present invention.

Figure 2:
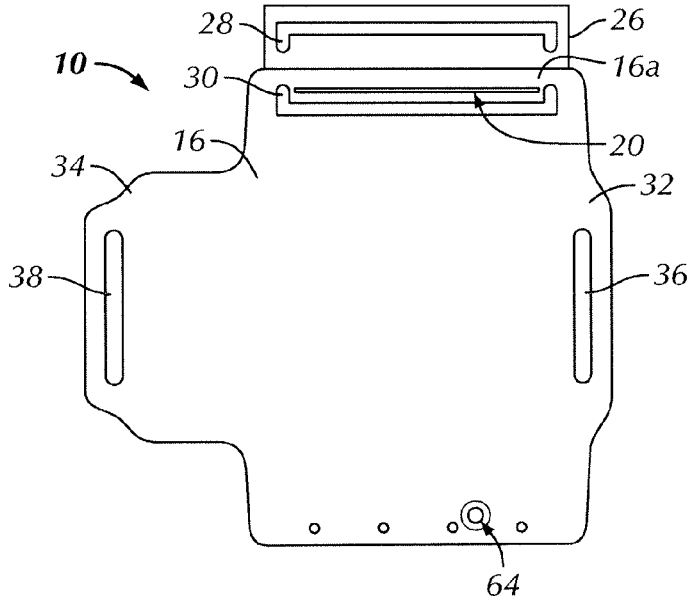
FIG. 2 is a rear elevational view of the main body shown in FIG. 1.

With particular reference to FIGS. 1-2, the armband, generally designated 10, comprises a main body 12 having a first or front surface 14 and an opposing second or rear surface 16. A longitudinal axis L of the main body 12 extends from a first or upper end 12*a* toward an opposing second or bottom end 12*b*. A cavity or pocket 18 is formed between the front and rear surfaces 14, 16 of the main body 12. The pocket 18 may have any size and shape. Preferably, however, the size and shape of the pocket 18 conform to the size and shape of an electronic device (not shown), such as a mobile telephone or a mobile music player. As such, the pocket 18 is configured to removably receive an electronic device therein. Preferably, the pocket 18 has a generally rectangular shape.

An upper end 16*a* of the rear surface 16 of the main body 12 preferably includes a slit or opening 20 which extends perpendicular to the longitudinal axis L of the main body 12. The slit 20 serves as an access point for the pocket 18 and thus preferably extends to a length that is sufficient to allow an electronic device to pass therethrough. Thus, in use, a user inserts an electronic device into the pocket 18 of the armband 10 via the slit 20. The armband 10 preferably further includes a first flap 26 configured to cover the slit 20. More particularly, the first flap 26 is a piece of material that extends upwardly and outwardly from the upper end 12*a* of the main body 12. Preferably, the material of the first flap 26 is treated with a moisture resistant or moisture impervious coating.

Preferably, a first fastening element 28, such as a Velcro® strip or other hook and loop type fastener, is provided on one edge of the first flap 26. The first flap 26 may be folded either toward the front surface 14 or toward the rear surface 16. Preferably, the first flap 26 is configured to fold toward the rear surface 16 and is of a sufficient size to cover the slit 20. Once the slit 20 is covered, the first fastening element 28 preferably mates with a corresponding second fastening element 30, such as a Velcro® strip or other hook and loop type fastener, provided proximate the slit 20 to secure the first flap 26 to the rear surface 16. More particularly, the second fastening element 30 preferably extends along the length of the slit 20 and is formed at a position longitudinally below the slit 20. The first and second fastening elements 28, 30 may have any suitable shape. In one embodiment, each of the first and second fastening elements 28, 30 is generally U-shaped.

Thus, in an assembled position, the first flap 26 securely covers the slit 20 after the electronic device has been inserted into the pocket 18. Accordingly, the first flap 26 prevents outside elements, such as rain, snow and the like from entering the slit 20 and contacting (and thus damaging) the inserted electronic device. More particularly, due to the moisture resistant material of the first flap 26, any moisture which contacts the first flap 26 is preventing from permeating therethrough and instead travels downwardly via the exterior surface of the first flap 26 and off of the armband 10.

Alternatively, in another embodiment, the pocket 18 may extend from above the slit 20 to below the slit 20, such that a first portion of the pocket 18 is formed above the slit 20 and a second portion of the pocket 18 is formed below the slit 20. A portion of the rear surface 16 of the main body 12 which covers the first portion of the pocket 18 may also overlap at least slightly with a portion of the rear surface 16 of the main body 12 which covers the second portion of the pocket 18. Thus, in an assembled position, a majority of the body of the electronic device is received within the second portion of the pocket 18 below the slit 20 and the remainder of the body of the electronic device is received within the first portion of the pocket 18 above the slit 20. Accordingly, the electronic device is fully covered by the rear surface 16 of the main body 12, such that outside elements (e.g., rain, snow and the like) are prevented from entering the slit 20 and contacting (and thus damaging) the inserted electronic device.

Figure 3:
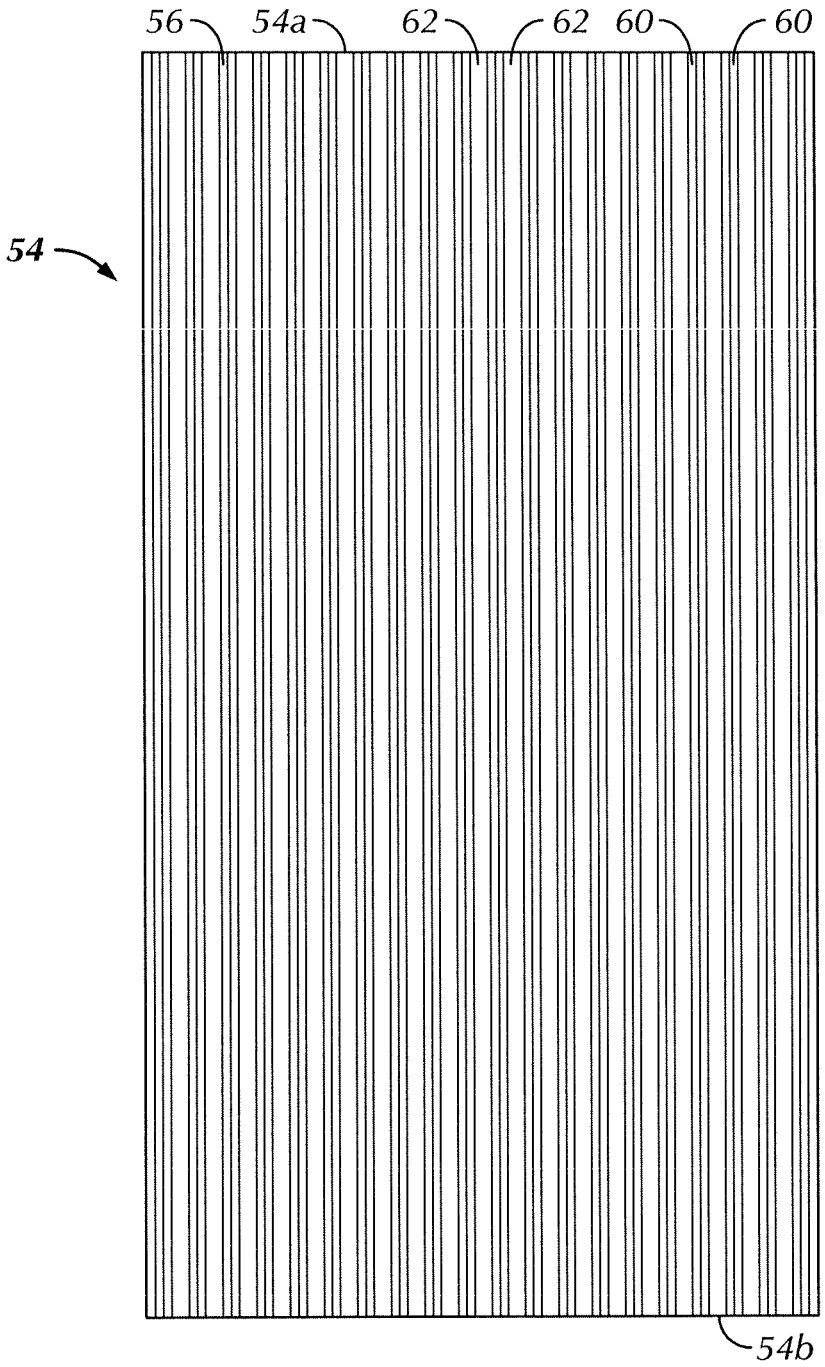
FIG. 3 is a front elevational view of a moisture diverter of an armband in accordance with a preferred embodiment of the preset invention.
Figure 4:
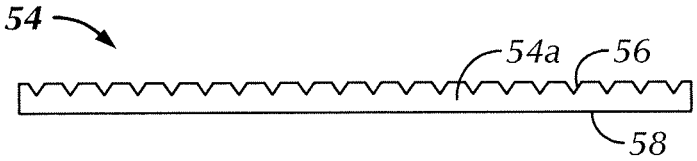
FIG. 4 is a side elevational view of the moisture diverter shown in FIG. 3.

Referring to FIGS. 3-4, in one embodiment, the armband 10 further includes a moisture diverter 54. The moisture diverter 54 preferably has a relatively small thickness (preferably approximately ⅛ inch) and is made of a generally flexible material, such as a soft molded rubber. Preferably, the moisture diverter 54 is made of a rubber material having a Shore A hardness of between approximately 25 and 30. The moisture diverter 54 may have any size and shape. Preferably, however, the size of the moisture diverter 54 is at least slightly smaller than or equal to the size of the pocket 18 and the shape of the moisture diverter 54 generally conforms to the shape of the pocket 18. The moisture diverter 54 preferably has a generally rectangular shape and is configured to be removably inserted into the pocket 18.

The moisture diverter 54 has a first or front surface 56 and an opposing second or rear surface 58. The rear surface 58 is preferably a generally planar or flat surface. The front surface 56 includes a plurality of spaced-apart ribs 60 which extend generally parallel to the longitudinal axis L of the main body 12 from an upper end 54*a* of the moisture diverter 54 toward, and more preferably to, a bottom end 54*b* of the moisture diverter 54. The spaces 62 in between the ribs 60 are preferably longitudinally-extending channels configured to divert perspiration generated by the user or any external precipitation or moisture.

In an assembled position of the armband 10, the moisture diverter 54 is inserted within the pocket 18 through the slit 20 and positioned behind the electronic device (i.e., in contact with the rear surface 16 of the main body 12). The front, ribbed surface 56 of the moisture diverter 54 contacts the rear surface 16 of the main body 12, while the rear surface 58 of the moisture diverter 54 is distal from the rear surface 16 of the main body 12. Thus, the front, ribbed surface 56 faces the user's arm. In the event that any perspiration generated by the user or other moisture permeates the rear surface 16 of the main body 12, or otherwise enters the pocket 18, the perspiration or other moisture is collected within the longitudinally-extending channels 62 and diverted toward the bottom end 12*b* of the main body 12 due to gravity. The rear surface 16 of the main body 12 preferably includes at least one opening or hole 64 proximate the bottom end 12*b* from which the collected and diverted perspiration or moisture may exit the armband 10 (see FIG. 2).

Referring to FIG. 1, the front surface 14 of the main body 12 preferably includes an opening or window 22 through which the interior of the pocket 18 is visible. Thus, when an electronic device is stored within the pocket 18, the user may view a screen of the electronic device through the window 22. Preferably, the window 22 has a generally rectangular shape, but it will be understood that the window may have any shape as long as at least a portion of the display screen of the inserted electronic device is visible.

In one embodiment, the window 22 preferably includes a transparent polymeric or plastic cover or shield 24 to protect the display screen of the inserted electronic device. Preferably, the edges of the transparent shield 24 are heat sealed to the front surface 14 of the main body 12, such that no outside elements, such as rain, snow and the like, can enter the pocket 18 via the edges of the transparent shield 24.

Referring to FIGS. 1-2, the armband 10 preferably further includes a second flap 32 and a third flap 34, both in the form of pieces of material which extend outwardly from the main body 12. The second flap 32 preferably extends outwardly from a left-hand side 12*c* of the main body 12 (when viewing the front surface 14) and the third flap 34 preferably extends outwardly from a right-hand side 12*d* of the main body 12 (when viewing the front surface 14). The main body 12 and the first, second and third flaps 26, 32, 34 are all preferably made from a generally flexible and water resistant material. More preferably, the main body 12 and the first, second and third flaps 26, 32, 34 are made from a material which is water resistant or water impervious. An example of a suitable water resistant and/or water impervious material includes neoprene. It will be understood that the material of the main body 12 and the first, second and third flaps 26, 32, 34 may be treated with a moisture resistant or moisture impervious coating. It will also be understood that the main body 12 and the first, second and third flaps 26, 32, 34 may each be made of different materials.

Figure 5:
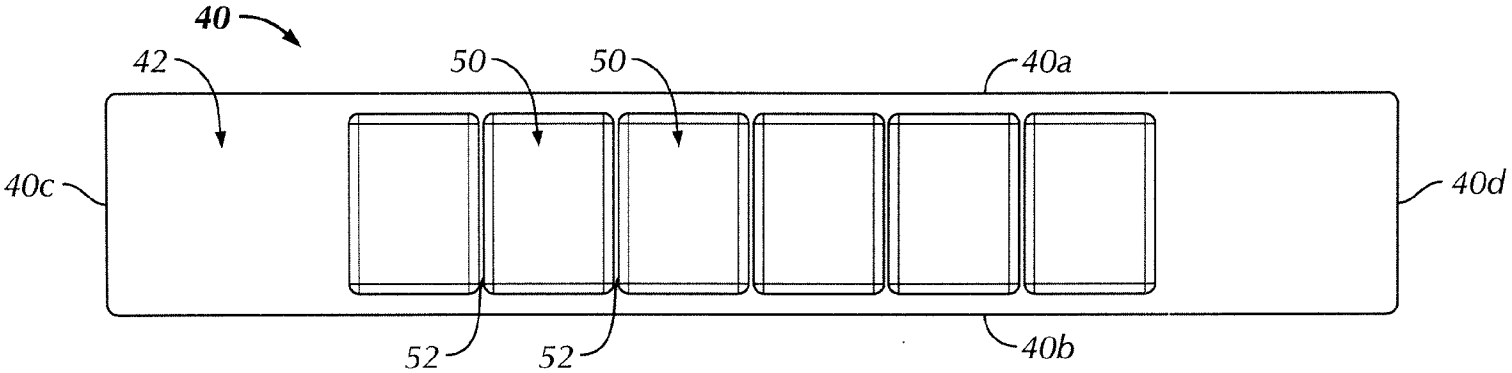
FIG. 5 is front elevational view of a securing strap of an armband in accordance with a preferred embodiment of the preset invention.
Figure 6:
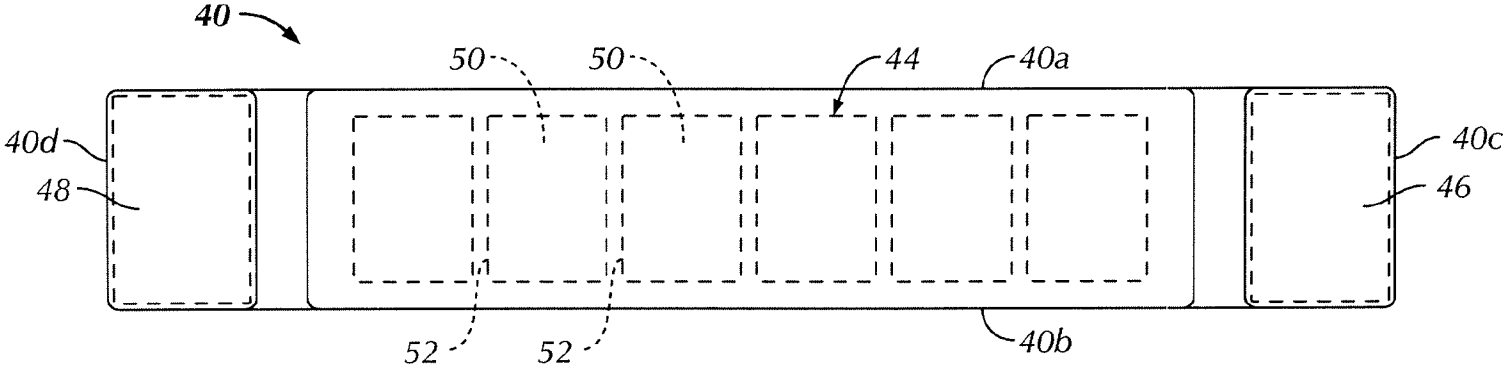
FIG. 6 is a rear elevational view of the securing strap shown in FIG. 5.
Figure 7:
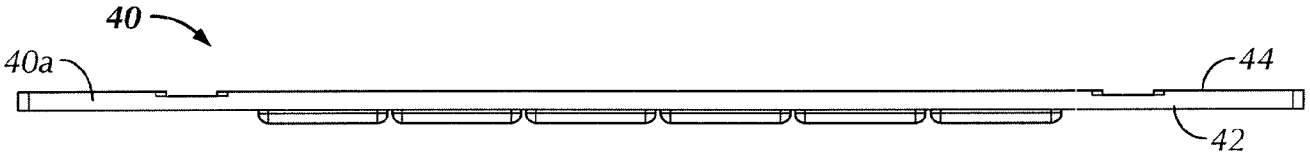
FIG. 7 is a side elevational view of the securing strap shown in FIG. 5.

Each of the second and third flaps 32, 34 preferably includes a respective slit 36, 38 configured to receive a securing strap 40 therethrough. Referring to FIGS. 5-7, the securing strap 40 has a generally rectangular shape and includes a first or front surface 42 and an opposing second or rear surface 44, a first or upper end 40*a* and an opposing second or lower end 40*b*, and opposing left-hand and right-hand distal ends 40*c* and 40*d*. The front surface 42 is a contact surface, while the rear surface 44 is an exposed surface. More particularly, in an assembled position of the armband 10, the front surface 42 is in contact with a portion of the arm of a user. The securing strap 40 is preferably made from a generally flexible and water resistant material. More preferably, the securing strap 40 is made from a material which is water resistant or water impervious.

The opposing left-hand and right-hand distal ends 40*c* and 40*d* are provided with corresponding first and second fastening elements 46, 48, respectively, which mate with each other to secure the securing strap 40 around a portion of the arm of a user. Preferably, the opposing left-hand and right-hand distal ends 40*c* and 40*d* are provided with corresponding or mating Velcro® strips or patches, or another type of hook and loop fastener.

The center core of the securing strap 40, located between the opposing left-hand and right-hand distal ends 40*c* and 40*d*, is preferably made of an elastic material which is water resistant or water impervious. More particularly, the center core preferably includes at least one and, more preferably a plurality of, spaced-apart cushion portions, pockets or bands 50 formed on the front contact surface 42 of the securing strap 40. The cushion bands 50 are preferably equally spaced-apart from each other. The spacing between the cushion bands 50 may vary as necessary, but is preferably approximately 3 millimeters. The cushion bands 50 may be formed on the front surface 42 of the securing strap 40 by any known means, such as an adhesive, stitching, and the like. It will be understood by those skilled in the art that while six cushion bands 50 are shown in FIGS. 6-7, the securing strap 40 may include any number of cushion bands 50.

Each cushion band 50 is preferably formed of a compressible, resilient and generally non-elastic material, such as a compression foam material. Preferably, each cushion band 50 is formed of a neoprene material or a material similar thereto which is generally inelastic. Thus, the securing strap 40 is made of a plurality of inelastic and compressible portions in the form of the cushion bands 50 and a plurality of elastic portions in the form of the spaces 52 between the cushion bands 50 thereby forming the elastic center core of the securing strap 40. Preferably, the cushion bands 50 provide for a more comfortable fit of the securing strap 40 around a user's arm, as the bands 50 allow for a closer and snugger fit of the securing strap 40 around the user's arm without compressing the user's arm.

The spaces 52 between the cushion bands 50 are preferably channels configured to direct perspiration generated by the user or any other moisture away from the electronic device inserted in the pocket 18 of the armband 10. More particularly, each channel 50 extends from the upper end 40*a* of the securing strap 40 toward, and more preferably to, the bottom end 40*b*. Thus, as the user exercises, his or her body generates perspiration which is gathered in the channels 50 between the spaced-apart cushion bands 50, is subsequently directed in a downward direction toward the bottom end 40*b* of the securing strap 40, and exits the securing strap 40. Thus, the generated perspiration does not contact the inserted electronic device, but rather runs down the user's arm.

The armband 10, in an assembled position comprising the main body 12, the moisture diverter 54 and the securing strap 40, thus provides a secure carrier for an electronic device which is both comfortable for the user and also protects the electronic device against damage that may be caused by any moisture, such as the user's perspiration, snow, rain, and the like.

It will also be appreciated by those skilled in the art that changes could be made to the embodiments described above without departing from the broad inventive concept thereof. Also, based on this disclosure, a person of ordinary skill in the art would further recognize that the relative proportions of the components illustrated could be varied without departing from the spirit and scope of the invention. It is understood, therefore, that this invention is not limited to the particular embodiments disclosed, but it is intended to cover modifications within the spirit and scope of the present invention as defined by the appended claims.

I claim:

1. An armband for an electronic device, the armband comprising:

a main body having a first surface and an opposing second surface, a first end and an opposing second end, and a longitudinal axis extending from the first end toward the opposing second end;

a pocket formed between the first and second surfaces of the main body, the pocket being configured to removably receive an electronic device therein;

an opening formed in the second surface of the main body, the opening providing access to the pocket and extending perpendicular to the longitudinal axis of the main body;

an insert configured to be removably received within the pocket, the insert comprising opposing first and second surfaces, the first surface of the insert having a plurality of spaced-apart ribs and a plurality of spaced-apart channels extending generally parallel to the longitudinal axis of the main body, the plurality of spaced-apart channels being configured to divert moisture toward the second end of the main body; and a securing strap configured to removably secure the main body to an arm of a user.

2. The armband of claim 1, wherein the insert is made of a flexible rubber material.

3. The armband of claim 2, wherein the insert is made of a rubber material having a Shore A hardness of between approximately 25 and 30.

4. The armband of claim 1, wherein the plurality of channels are formed by spaces between the plurality of spaced-apart ribs.

5. The armband of claim 1, wherein in an assembled position, the front surface of the insert is in contact with the second surface of the main body.

6. The armband of claim 1, wherein the second surface of the main body includes at least one opening proximate the second end through which the diverted moisture may exit.

7. A securing strap for an armband for an electronic device, the securing strap comprising:

a first surface and an opposing second surface;

a first end having a first fastening element and an opposing second end having a corresponding second fastening element, the first and second fastening elements being configured to mate with each other;

a center region located between the first end and opposing second end;

a plurality of spaced-apart inelastic and compressible cushion members formed on the first surface in the center region, and a plurality of elastic channels formed by spaces between the plurality of spaced-apart cushion members.

8. The securing strap of claim 7, wherein the first surface is configured to contact a portion of the arm of a user.

9. The securing strap of claim 7, wherein the first and second fastening elements are hook and loop fasteners.

10. The securing strap of claim 7, wherein each cushion member includes a compression foam material.

11. The securing strap of claim 10, wherein each cushion member is formed of a neoprene material.

* * * * *